United States Patent [19]

Driscoll

[11] 4,354,119

[45] Oct. 12, 1982

[54] CONTROL STATION FOR OVERHEAD MOUNTING

[76] Inventor: Neil J. Driscoll, 2456 Argonne Way, Medford, Oreg. 97501

[21] Appl. No.: 203,725

[22] Filed: Nov. 3, 1980

[51] Int. Cl.[3] ..... H01H 17/26

[52] U.S. Cl. ..... 307/115; 200/61.77; 200/161; 200/283; 318/446

[58] Field of Search ..... 307/115; 318/446; 200/153 F, 156, 161, 52 R, 61.77, 61.69, 283, 331; 49/199, 359; 160/331

[56] References Cited

U.S. PATENT DOCUMENTS

| | | | |
|---|---|---|---|
| 1,984,921 | 12/1934 | Ehrlich | 200/161 |
| 2,401,213 | 5/1946 | Wood | 200/283 |
| 2,636,091 | 4/1953 | Carter | 200/161 |
| 2,920,151 | 1/1960 | Lawick | 49/199 |

FOREIGN PATENT DOCUMENTS

| | | | |
|---|---|---|---|
| 677205 | 12/1963 | Canada | 160/331 |

*Primary Examiner*—John W. Shepperd

[57] ABSTRACT

The control station comprises an enclosure having two terminal blocks disposed therein. Each terminal block has a set or normally opened and normally closed contacts which are mechanically interlocked and movable into an open and closed position respectively by an actuating lever. The ground terminals of each set of contacts on each terminal block are electrically interlocked for common connection to an external ground line. The wiring terminals of the normally closed contacts are electrically interlocked to provide a parallel connection through the respective normally closed contacts between an external circuit and the ground line. The terminal of the normally open contact on each terminal block is electrically connected to an external circuit, each proceeding an independent sequence for some controlled device when the contact is closed. Each actuating lever has depending therefrom a shock absorbing elastomeric cord which may be pulled by the operator to close the normally open contact and concurrently open the normally closed contact. Pulling one cord initiates a first sequence of operation and pulling the other cord initiates a second sequence of operation in the equipment being controlled. Pulling both cords at the same time initiates a third sequence of operation in the equipment being controlled. Barrier means are provided to shield the movable levers.

5 Claims, 6 Drawing Figures

Fig. 1.
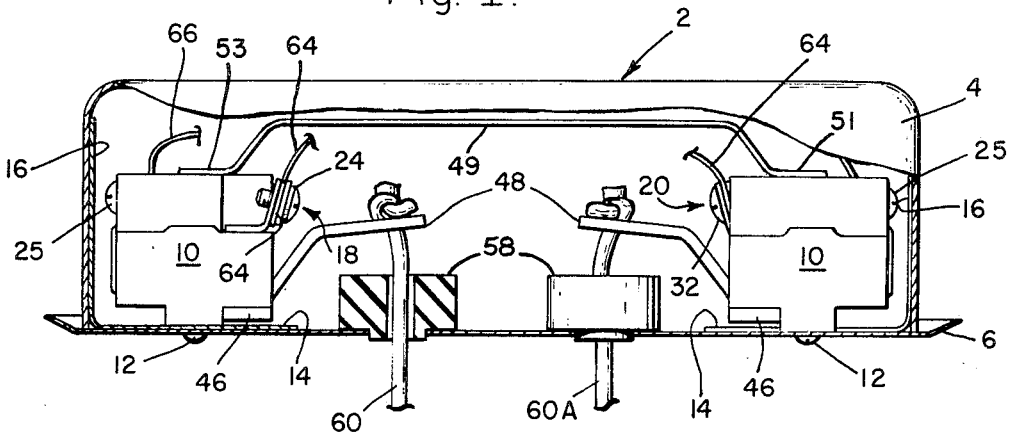
Fig. 2.
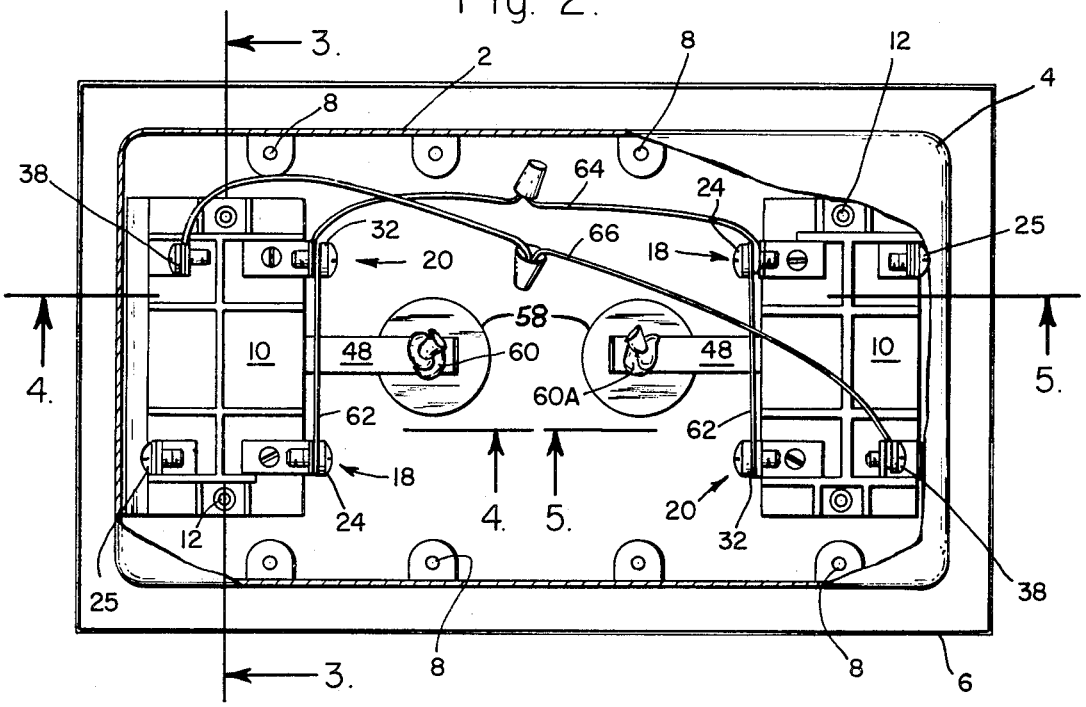
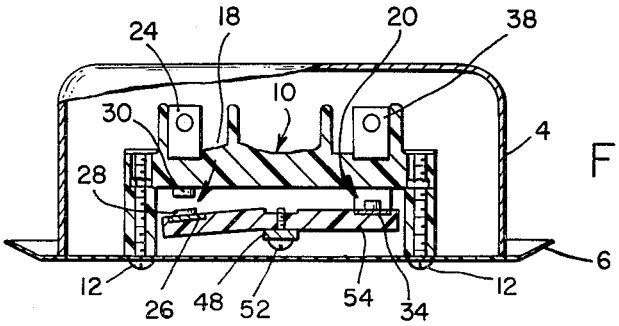
Fig. 3

Fig. 4.
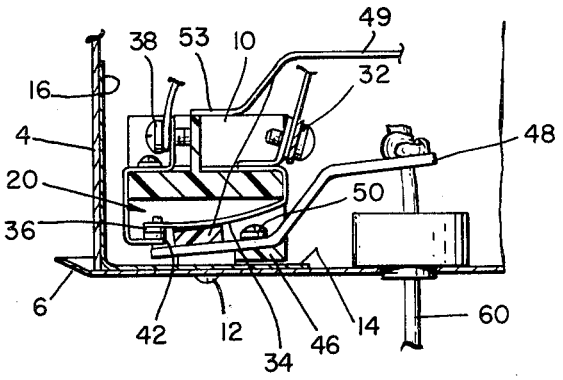
Fig. 5.
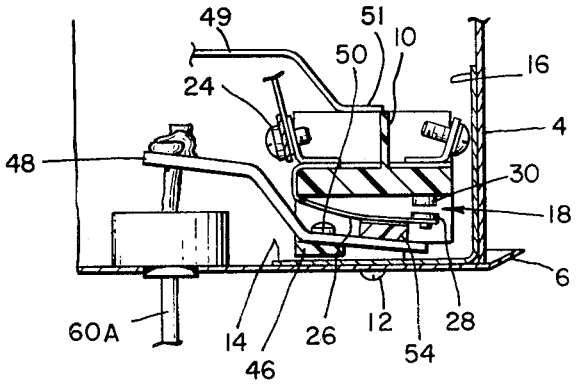
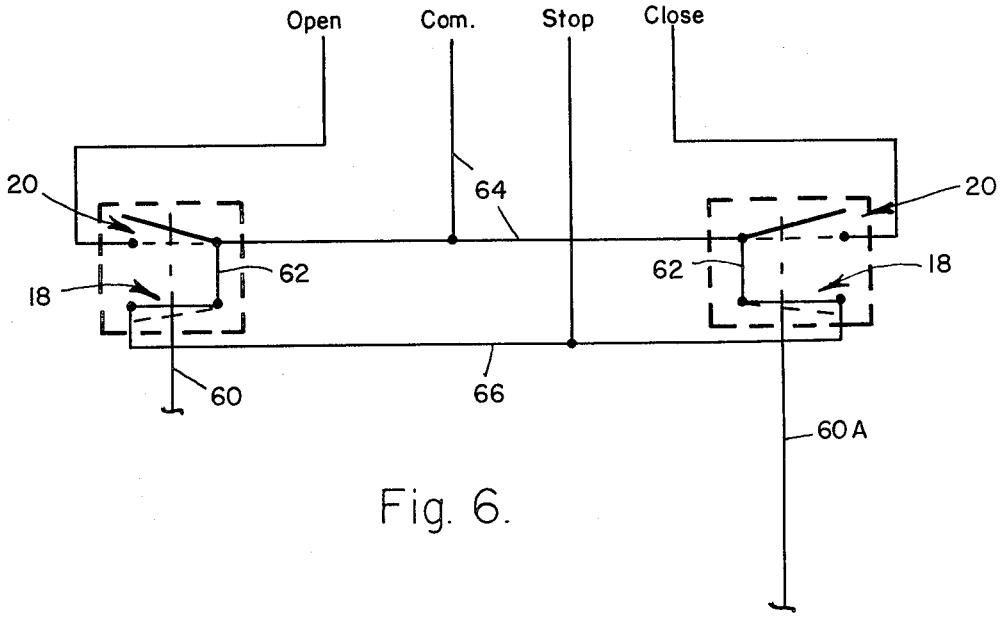
Fig. 6.

CONTROL STATION FOR OVERHEAD MOUNTING

BACKGROUND OF THE INVENTION

Field of the Invention

The invention relates to momentary contact switching devices of the type that may be used with magnetically operable across the line power switching units. The momentary devices may have normally open or normally closed electrical contacts or a combination of both. They are known in the art as auxiliary devices, e.g., push button control stations.

SUMMARY OF INVENTION

The invention relates to a control station similar to the type generally known as a push-button control station but adapted for overhead mounting on a ceiling or the like and having depending therefrom a pair of pull cords or lanyards which may be alternately manually pulled to initiate a first and second sequence of operation in a device being controlled and which may be concurrently pulled to initiate a third sequence of operation in the equipment being controlled.

Push button control stations are common devices used to control operating equipment. For example, industrial power-operated doors used in factories, warehouses and the like utilize push button control stations to open, close and stop operation of each door unit. The control stations are wired so that the power-operated equipment will open the door when push button is depressed, close the door when another push button is depressed, thereby achieving two operating sequences from a single control station and, in certain applications, a stop button provides a means for halting the door at any position—intermediate, full open or full closed position. In the latter circumstance, each push button control station thereby can provide three operating sequences in the power door equipment.

Normally, the push button control station is surface-mounted on a wall, post or the like in close adjacency to the door equipment being controlled. To avoid delay and to enhance the smooth and efficient flow of mean and material throughout an operating plant, such as, for example, when goods are being moved on a forklift tow motor or the like, it is desirable that the operator avoid stopping his quipment and walking to a wall-mounted push button control station to open or close a power-operated door. It is desirable, therefore, to provide a control device mounted overhead with depending cords for the operator to grab as he moves through the area and thereby initiate door operation without going to and returning from a wall-mounted pushbutton unit. The time advantage and efficiency is thought obvious.

Because of the rough abuse incident to such service, prior art switching devices for overhead mounting have been subject to frequent failures and breakdowns. The abuse received is severe. For example, a forklift operator moving at approximately ten miles per hour can, and frequently will, severely impact the depending actuating cord. Also, where a single cord is provided for each of the operating sequences (for example, open, close and stop), the cords become tangled, or the operator will grab the wrong cord, which causes delay. These are but a few of the disadvantages of the prior art overhead control devices.

Accordingly, it is a primary object of the invention to provide an overhead mounted control device adapted to withstand the severe abuse incident to such service operation.

It is a further object of the present invention to provide an overhead mounted control device capable of affording three sequences of operation. For example, open, close and stop, with only two depending operating cords or lanyards.

It is yet another primary object of the invention to provide a device of the type described which incorporates structure to minimize or eliminate transfer of impact or shock to the switching device when the depending lanyard is operated and, thereby eliminate a primary cause of device failure.

It is a specific object of the invention to provide an overhead mounted control device having the mentioned features of durability and ease of operation which is economical in initial cost.

These and other objects and advantges of the invention will be more clearly understood by reference to the associated drawings and following specification, wherein:

BRIEF DESCRIPTION OF THE DRAWINGS

FIG. 1 is a side elevational, partially fragmentary view of an enclosure incorporating an embodiment of the invention;

FIG. 2 is a plan view of the structure shown in FIG. 1, the enclosure being fragmented to illustrate the internal structure;

FIG. 3 is a sectional view taken along line 3—3 of FIG. 2;

FIG. 4 is a fragmentary sectional view taken along line 4—4 of FIG. 2;

FIG. 5 is a fragmentary sectional view taken along line 5—5 of FIG. 2; and FIG. 6 is a schematic electro-mechanical layout illustrating the function and structure of the invention.

DESCRIPTION OF THE PREFERRED EMBODIMENT

An enclosure, of any conventional type, is indicated generally at 2. The enclosure comprises an electrical outlet box 4 and coverplate 6 secured to the box by the screws 8. In normal service applications, the box 4 is secured to a mounting surface (not shown) such as an overhead ceiling or the like, in control proximity to the operating equipment such as a power industrial door. However, the device may control many types of equipment and is not limited in service to power-operated doors.

It will be understood that certain features of the invention may be utilized in single sequence devices similar to a single push button control station. Likewise, features of the invention may be utilized in a two-sequence equipment operation, such as opening and closing an industrial door. However, a preferred embodiment of the invention resides in providing three sequences of operation while utilizing only two depending operator cords or lanyards.

In a three-sequence embodiment of the invention, two terminal blocks or terminal block structures, each of identical construction, are required. Referring to FIGS. 1 and 2, each block structure comprises basic terminal block 10 of insulating material such as bakelite, each block being mounted to the cover 6 by screws 12—12. The mounting includes a flexible insulating barrier 14 interposed between the block and cover 4 and projecting upwardly along one side of each block 10 as at 16. The barrier 14 insulates the terminal block structure from the enclosing metallic box 4.

The switching structure of each terminal block comprises normally open and closed contact structures, indicated generally at 18 and 20, respectively. The normally open contact structure 18 is shown in detail in FIGS. 3 and 5 and comprises wiring terminals 24 and 25. Terminal 24 is mounted to block 10 and abutes and secures flexible current carrying finger 26 and in aligned relation with another electrical contact 30, which is electrically attached to the wiring terminal 25. The contacts 28 and 30 are normally open, as illustrated.

FIGS. 3 and 4 detail the normally closed contact structure 20. The closed contact structure 20 comprises a first wiring terminal 32 secured to the block 10 abuting and securing a flexible current carrying finger 34 to the block 10. An electrical contact 36 is attached to the end of the finger 34. Another wiring terminal 38 is secured to the block 10 and includes segment 40 which projects downwardly and mounts electrical contact 42 in normally closed abuting relation with contact 36.

Each terminal block includes a pivot base 46 which pivotally mounts offset actuating arm 48, as at 50, for arm rocking motion hereinafter described in detail. Each arm 48 has secured to its inner end (as at 52) a finger interlock bar 54, the bar 54 having cavities near its opposite extremities to receive the described fingers 26 and 34 (FIG. 3).

Each actuating arm 48 of the respective terminal block structure has secured thereto a depending or pendant pull cord or lanyard here designated 60 and 60A (FIGS. 1, 2, and 6). The cords 60 and 60A, below each lever 48, extend through the aligned positive stops and cord guides 58, 58, which are in turn secured to cover 6. A barrier 49 may be secured at opposed ends thereof, as at 51 and 53 to the respective terminal blocks 10. The barrier 49 protects the movable actuating arms 48 from interfering with electrical wiring which is placed in the enclosure at installation.

In the preferred embodiment of the invention it is desirable that each pivot base 46 and finger receiving interlock bar 54 be of insulating material such as nylon plastic. The positive stop and cord guides 58, 58 should also be of insulating material and are preferred somewhat flexible since they act as abutments for the levers 48 to inhibit excessive rocking movement of the respective levers and hence may be constructed of neoprene rubber of approximately 60 durometer hardness. The actuating arms 48 may be metallic material. On the other hand, the lanyards 60 and 60A which provide forced transmission to each terminal block preferably offer a shock-absorbing characteristic as they may be rather roughly handled by operating personnel. The cords or lanyards 60 and 60A, therefore utilized in the invention, are an elastomeric rubber material having a fabric covering such as woven nylon or cotton which accommodate a substantial lanyard elongation under pull approaching 90 or 100 percent with virtual complete recovery when the pulling force is released. The lanyard will, however, transmit the 4 or 5 ounces of pressure required to actuate the normally open and normally closed contacts within the first few inches of lanyard pull and will absorb substantially all of the additional force which an operator may apply to the lanyard. In addition, the rubber positive stops 48 prevent the related actuating arm 48 from excessively pivoting about the screw 50, thereby limiting the amount of force that is transmitted to the terminal block 10. Eah interlock bar 54, being of insulating nylon material, is also somewhat flexible and therefore aids in avoiding impact shock during contact closure. It will be thus apparent that the entire arrangement is of such design that impact and rough handling by operating personnel will not damage the control device in its function or operation.

Briefly describing the operation of the device, it will be apparent that normal, downward movement either pull cord or lanyard 60 or 60A, will induce pivotal movement of the associated actuating arm 48, said movement inducing flexing of the fingers 26 and 34 via the interlock bar 54. The stops 58 limit downward pivotal movement of the arms 48 as above described. Thus, the pivotal movement of each arm 48 under the actuation of its control lanyard 60 or 60A and the resultant movement of the interlock bar 54 sequentially opens the closed contacts 36 and 42 and then closes the normally open contacts 28 and 30. The geometry of the entire arrangement is such that the opening of the normally closed contacts 36 and 42 leads the closing of the normally open contacts 28 and 30. Upon release of the related cord or lanyard 60 or 60A, the flexible fingers and their inherent spring action return the structure to the normally open and normally closed position shown in FIGS. 3, 4, and 5.

Referring to FIGS. 2 and 6, it will be seen that the terminals 24 and 32 of each terminal block are provided with electrical jumper bars 62,62, which define the ground side of the terminal block's structure. Thus, the common ground of each terminal block may be electrically interlocked via wire 64. In a similar manner, normally closed contact terminal 38,38 of the respective blocks are likewise wire interlocked via wire 66, whereby both of the normally closed contacts 20 are in electrical parallel relation to each other and to the common or ground wires 64.

FIG. 6, when considered with the above described structure, illustrates the function of the control arrangement. Its operation will be described in relation to the opening, closing and stopping of an industrial powered door. In this connection, it will be understood that the power door structure will stop when the circuit through both normally closed contacts to common ground is opened. With this in mind, to initiate the open cycle or sequence of the power door, the operator merely pulls the lanyard 60. This manual action closes the normally open contact 20 and opens the normally closed contact 18 associated with the lanyard 60. The closed circuit is maintained through normally closed contacts 18 associated with the lanyard 60A. Closure of the normally open contacts 20 associated with lanyard 60 initiates the open cycle until that function is completed. When it is desired to close the power door, the operator merely pulls the longer lanyard 60A, which closes the related normally open contacts 20 and opens the related normally closed contact 18. Again, a normally closed contact circuit is maintained through the normally closed contacts 18 associated with the short cord lanyard 60. The sequence thus initiated continues until the associated power door closes. If the operator desires to halt door opening or closing at any point intermediate in the full open or full closed position, he merely concurrently pulls lanyards 60 and 60A which opens both normally closed contacts 18 at respective terminal block, stopping the power door at that position. Recalling that the opening of the normally closed contacts leads the closure of the normally open contacts on the respective terminal blocks, the third or stopping sequence is achieved without initiating either the open or closing sequence, as that cannot occur while normally closed contacts are open.

It will thus be understood that the features, objects and advantages of the invention described above have been achieved. The control device efficiently provides one, two or three sequence operation. All of the operating components of the arrangement inhibit and prevent the transmission of excessive force or impact to the comparatively delicate switching mechanisms, thus accommodate the hard use incident to this type of service.

The invention as shown and described is by way of illustration only and not limitation, as will be understood by reference to the following claims.

What is claimed is:

1. In a control device for overhead mounting and operative to control related equipment, an enclosure for the device and adapted to receive electrical wiring for connection to the device, terminal block means fixedly mounted in the enclosure, first stationary contact means on the terminal block means and second stationary contact means on the terminal block means spaced from the first stationary contact means, first flexible electrical current conductive finger means carrying other electrical contact means in operative relation to said first stationary contact means, second flexible electrical current conductive finger means carrying other electrical contact means in operative relation to said second stationary contact means, bar means engaging the first flexible finger means and the second flexible finger means, lever means pivotally movable relative to the enclosure and connected to the bar means intermediate the flexible finger means whereby movement of the lever means moves the bar means and induces concurrent movement of the flexible finger means and the carried other electrical contact means in operative relation with the stationary contact means, cord means connected to the lever means and depending from the enclosure to provide movement for the lever means by operator pulling of the cord means, and fixed barrier means in the enclosure to separate the lever means from electrical wiring in the enclosure during operation.

2. In a control device for overhead mounting and operative to control related equipment, an enclosure, said enclosure adapted to receive electric wires for connection to the device, a first and second terminal block in the enclosure, each terminal block having first and second sets of contacts thereon, mechanical means for interconnecting the first and second sets of contacts on each terminal block, movable lever means connected to the respective mechanical mens to initiate mechanical means movement and thereby move the related sets of contacts into and out of operating position, first and second cord means connected to the respective lever means, said cord means depending from the devicve and each accessible to operator pull, thereby initiating movement of the attached lever means, whereby movement of said first cord means induces movement of said sets of contacts on one terminal block into and out of operating position, thereby initiating a first sequence of operation in the related equipment, movement of the second cord means induces movement of said sets of contacts on the other terminal block into and out of operating position, thereby initiating a second sequence of operation in the related equipment, concurrent movement of said first and second set of cord means induces concurrent movement of the sets of contacts on both terminal blocks, and thereby initiating a third sequence of operation in the related equipment, and means within the enclosure to maintain said movable lever means and electric wires separated and thereby prevent physical contact therebetween.

3. In a control device for overhead mounting, an enclosure, said enclosure being adapted to receive electrical wires for connection to the device, first and second terminal blocks in the enclosure, each terminal block having first and second sets of contacts thereon, a bar on each terminal block interconnecting the first and second sets of contacts, a movable lever connected to each bar, a first depending cord means connected to one movable lever, a second depending cord means connected to the other movable lever, the first set of contacts on each terminal block being normally open, the second set of contacts on each terminal block being normally closed, the normally closed sets of contacts on the respective terminal blocks being electrically interconnected to provide parallel paths to ground, movement of the first cord means being operative to induce movement of one movable lever and induce opening of the related set of normally closed contacts and closing of the related set of normally open contacts, movement of the second cord means being operative to induce movement of said other movable lever and induce opening of the related set of normally closed contacts and closing of the related set of normally open contacts, concurrent movement of the first and second cord means being operative to induce opening of the related set of normally closed contacts on both terminal blocks and thereby open both parallel paths to ground, and barrier means within the enclosure to separate the movable levers from any electrical wires received by the enclosure.

4. A control device for overhead mounting according to claim 3, wherein said movable levers are pivotally movable, bumper means to limit pivotal movement of the levers, said cord means being elastically resilient, said barrier means comprising an element secured at opposed ends to respective terminal blocks and overlying said movable levers as seen in side elevational view.

5. A control device for overhead mounting according to claim 3, wherein the opening of the second set of normally closed contacts leads the closing of the first set of normally open contacts on each terminal block in response to movement of the related movable lever.

* * * * *